United States Patent [19]

Goldstein et al.

[11] Patent Number: 4,844,970

[45] Date of Patent: Jul. 4, 1989

[54] ZIRCONIUM (III) SALTS AS CURE CO-CATALYSTS FOR NONWOVEN BINDERS COMPRISING ACRYLAMIDOGLYCOLIC ACID

[75] Inventors: Joel E. Goldstein; John G. Iacoviello, both of Allentown; Gary G. Hawn, Wescosville; Gerald R. Cook, Wyomissing, all of Pa.

[73] Assignee: Air Products and Chemicals, Inc., Allentown, Pa.

[21] Appl. No.: 142,980

[22] Filed: Jan. 12, 1988

[51] Int. Cl.[4] ..... B32B 27/00; C08L 39/00

[52] U.S. Cl. ..... 428/198; 428/288; 428/290; 523/111; 524/127; 524/555; 524/564; 524/813; 525/379; 525/381; 525/382; 526/304

[58] Field of Search ..... 428/198, 288, 290; 526/304; 524/127, 564, 555, 328.2, 813; 523/111; 525/379, 381, 382

[56] References Cited

U.S. PATENT DOCUMENTS

| | | | |
|---|---|---|---|
| 4,084,033 | 4/1978 | Drelich | 428/198 |
| 4,289,676 | 9/1981 | Czauderng et al. | 260/29.6 |
| 4,447,570 | 5/1984 | Cook et al. | 524/127 |
| 4,522,973 | 6/1985 | Lay et al. | 524/555 |

*Primary Examiner*—Marion C. McCamish

*Attorney, Agent, or Firm*—Keith D. Gourley; James C. Simmons; William F. Marsh

[57] ABSTRACT

A crosslinkable anionic binder composition which comprises an emulsion copolymer containing acrylamidoglycolic acid (AGA) and a zirconium III salt of an alpha or beta hydroxycarboxylic acid, the pH of the composition being from about 1.5 to 4.5. Provided are nonwoven binder compositions which are stable for extended periods prior to application of the binder composition onto the nonwoven substrate and initiation of crosslinking by application of heat.

20 Claims, No Drawings

ZIRCONIUM (III) SALTS AS CURE CO-CATALYSTS FOR NONWOVEN BINDERS COMPRISING ACRYLAMIDOGLYCOLIC ACID

TECHNICAL FIELD

The present invention relates to catalytically cured anionic nonwoven binder compositions containing carboxylate functionality.

BACKGROUND OF THE INVENTION

The rapid increase in sales of disposable nonwoven products over the past several years has intensified interest in improving emulsion polymers used to bind nonwoven fibers. Most conventional binders include a small amount of self-crosslinking agent, typically N-methylolacrylamide. The development of such self-crosslinking binders at the end of the 1950s was perhaps the most important factor in the growth and commercial acceptance of articles made from nonwoven staple fibers.

Unfortunately, nonwoven products made with such nonwoven binder compositions exhibit unacceptable loss in strength in the presence of water and other solvents. In addition, conventional binders containing phosphate surfactants exhibit poor adhesion to substrate including glass, metal and synthetics such as mylar. These shortcomings have been reduced in recent years by the use of adhesion promoting crosslinking comonomers and/or post-added crosslinkers.

Aminoplast chemistry is one of the most successful of the many chemistries employed in preparing nonwoven binder compositions. Particularly useful examples of compounds containing aminoplast functionality are N-methylolacrylamide (NMA) and urea-formaldehyde condensates. While these compounds are low in cost, compatible with aqueous emulsions, rapidly cured under acid catalysis and substrate reactive, they suffer from a major deficiency; the emission of low levels of formaldehyde, a suspected carcinogen. Many attempts have been made to overcome or minimize this deficiency, especially after the potential carcinogenicity and irritant properties of formaldehyde became widely recognized.

To reduce the level of formaldehyde in emulsion products, the use of O-alkylated NMA's such as isobutoxymethacrylamide (IBMA) or the use of 1:1 molar ratios of NMA with acrylamide were introduced. These materials did not, however, eliminate the presence of formaldehyde.

In recent years, investigation has focused on binder compositions incorporating carboxylate functionality in order to overcome the previously discussed deficiencies. The incorporation of acrylic acid and other carboxylic acid containing monomers into interpolymers is well known.

Crosslinking with metal ions including aluminum and zirconium has been disclosed as being useful for the insolubilization of carboxylic acid group-containing materials such as polyacrylic acid and starches containing carboxylic acid groups. Crosslinking afforded by such metal ions has been proposed to improve the mechanical properties of articles impregnated with nonwoven binders. U.S. Pat. Nos. 2,758,102 and 3,137,588 are illustrative.

U.S. Pat. No. 4,084,033 discloses a method for making nonwovens wherein an aqueous binder comprises a colloidal resin possessing a hydroxy-containing ligand.

These resins are obtained by copolymerizing from about 92 wt % to about 99 wt % of a monomer or mixture of monomers including vinyl acetate and ethylene. A small amount of from about 0.1 wt % to about 3 wt % of a coordination metal complex is then added to the resin. Suitable central metallic atoms for such metal complexes include zirconium, chromium, nickel cobalt, cadmium, zinc, vanadium, titanium, copper and aluminum. An example of a suitable coordination compound includes zirconium ammonium carbonate.

U.S. Pat. No. 4,289,676 discloses copolymeric binder compositions containing from 3 to 6 wt % acrylamidoglycolic acid (AGA), up to 3 wt % N-methylolacrylamide and not less than 85 wt % of:

(a) a mixture of from 40–60 parts by weight of styrene and/or acrylonitrile and from 60–40 parts by weight of butadiene or (b) vinyl monomers selected from the group consisting of esters of acrylic acid or methacrylic acid with alkanols of 1 to 8 carbon atoms, vinyl esters and vinyl chloride, together with up to 40% by weight, based on total monomers (b), of acrylonitrile, styrene or butadiene, and from 0 to 5% by weight of alpha, beta-monoolefinically unsaturated monocarboxylic acids and/or dicarboxylic acids of 3 to 5 carbon atoms and/or their amides, the said monomers being present as copolymerized units.

U.S. Pat. No. 4,447,570 teaches a binder composition for nonwoven fabrics. The binder comprises a base salt of a phosphate ester surfactant or carboxylate surfactant, a latex comprising vinyl acetate, ethylene and an olefinically unsaturated carboxylic acid interpolymer colloidally suspended in water. Additionally added is a polyvalent metal complex comprising a polyvalent metal ion (i.e. zirconium, aluminum, etc.) and counter ions or ligands which hinder interaction of the polyvalent metal ion with the carboxylate and phosphate groups of the surfactant at room temperatures. Heating serves to cure the binder by forming a crosslinked interpolymer caused by expelling or removing the counter ions or ligands and replacing them by the anionic groups of the surfactant and interpolymer.

U.S. Pat. No. 4,522,973 teaches a low temperature crosslinkable polymer emulsion containing methyl acrylamidoglycolate methyl ether (MAGME) and a crosslinking agent having a plurality of functional groups each capable at low temperature of replacing the alkoxy moiety of MAGME by nucleophilic substitution.

SUMMARY OF THE INVENTION

The present invention provides crosslinkable anionic binder compositions comprising a nonwoven binder emulsion copolymer containing acrylamidoglycolic acid (AGA) and a zirconium III salt of an alpha or beta hydroxycarboxylic acid wherein the pH of the composition ranges from about 1.5 to about 4.5.

Preferred binder compositions prepared according to the invention comprises an emulsion copolymer at about 35 to 65 wt % solids comprising about 55 to 95 wt % vinyl acetate, about 1 to 30 wt % ethylene and about 0.5 to 15 wt % AGA. The binder compositions can be cured at the desired time by heating to effect crosslinking. The strength of the bonded products is comparable to that obtained using current technology with the advantage that formaldehyde is not emitted.

Binder compositions containing the defined zirconium III organic salts can also be used as binder adhesives or substrate coatings, especially those with hydroxyl, carboxylic, primary or secondary amide surface groups. These emulsions should also be able to interact with oxirane (epoxide) containing polymers and should be suitable as adhesives for those systems.

This invention overcomes problems associated with the prior art with the advantage that the claimed binder compositions are stable at room temperature at pH values ranging from about 1.5 to about 4.5. Moreover, these binders can be prepared well in advance of the time desired for effecting crosslinking because curing begins only upon heating the binder-containing substrate to an elevated temperature.

An additional advantage of the present invention resides in the room temperature stability of the claimed binder compositions which substantially reduces the importance of using large amounts of carefully chosen surfactants to stabilize such compositions prior to applying them to nonwoven substrates and initiating the curing step.

Nonwoven products made from the claimed binder compositions exhibit the additional advantage of maintaining a greater degree of tensile strength when wetted with water and organic solvents, particularly mineral spirits and methyl ethyl ketone.

The claimed binder compositions are phosphate-free and the products made therefrom offer the additional advantage of exhibiting superior adhesion to substrates including glass, metal and sythetics thereby overcoming the deficiencies inherent to prior art compositions containing phosphate surfactants such as those compositions disclosed in U.S. Pat. No. 4,447,570.

The claimed binder compositions are particularly useful in commercial applications where long term stability is required before the actual crosslinking mechanism is induced by heat. Specifically, the binder compositions containing the disclosed zirconium III salts are stable at low pH values of about 1.5 to about 4.5 and in the presence of high solids formulations approaching 35% even in the presence of carboxyl and hydroxyl moieties. The claimed invention overcomes prior art problems relating to excessive viscosity and gelling that typically occur when AGA is present in solultion with metallic ions.

DETAILED DESCRIPTION OF THE INVENTION

The present invention provides a formaldehyde-free binder composition, post-catalytically cured by addition of a zirconium III salt of an alpha or beta hydroxycarboxylic acid such as zirconium ammonium citrate and zirconium ammonium lactate. The disclosed formaldehyde-free nonwoven binder compositions containing acrylamidoglycolic acid (AGA) as a crosslinking agent and cured with the disclosed zirconium III salts perform equivalently to formaldehyde-containing binder systems.

In a preferred embodiment, the binder composition comprises an aqueous dispersion of a vinyl acetate-ethylene copolymer at about 35 to 65 wt % solids. The copolymer comprises from 55 to 95 wt % vinyl acetate, 1 to 30 wt % ethylene and 0.5 to 15 wt % of AGA based upon the amount of vinyl acetate. Whenever "AGA" is used, it is to be understood that methacrylamidoglycolic acid (MethAGA) is also contemplated. Acrylamidoglycolic acid (AGA) and methacrylamidoglycolic acid are represented by Formula I wherein R is H and $CH_3$, respectively.

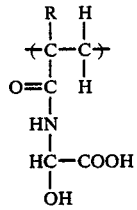

Formula I

The preferred copolymer consists essentially of from about 7 to 20 wt % ethylene, vinyl acetate and 3 to about 10 wt % AGA. Such copolymer emulsions which are useful as nonwoven binders have Brookfield viscosities ranging from 10 to 2600 cps, preferably 400–1000 cps. The copolymers have a Tg between −20° and 32° C., preferably −5° to 25° C.

Other copolymers suitable for practicing the claimed invention include those known in the art, such as those discussed in U.S. Pat. No. 4,289,676, which is incorporated by reference.

The zirconium III salts of alpha or beta hydroxycarboxylic acids useful to this invention, by way of example, include zirconium ammonium lactate, zirconium ammonium glycolate and zirconium ammonium trilactate. Particularly useful is zirconium ammonium citrate which can be formed in situ by reacting citric acid and ammonium zirconium carbonate. A more detailed discussion follows regarding how to make and use these zirconium III salts.

The vinyl acetate/ethylene/AGA (VAE/AGA) copolymers may optionally include one or more additional ethylenically unsaturated copolymerizable monomers. Exemplary of such comonomers, which may be present at up to 30 wt %, are $C_3$–$C_{10}$ alkenoic and alkenedioic acids, such as acrylic acid, methacrylic acid, crotonic acid, isocrotonic acid, maleic acid, fumaric acid and itaconic acid and their monoesters and diesters with $C_1$–$C_{18}$ alkanols, such as methanol, ethanol, propanol, butanol and 2-ethylhexanol; carboxyethyl acrylate; vinyl halides such as vinyl chloride; and nitrogen-containing monoolefinically unsaturated monomers, particularly nitriles, amides, N-methylolamides, lower alkanoic acid esters of N-methylolamides, lower alkyl ethers of N-methylolamides and allylcarbamates, such as acrylonitrile, acrylamide, methacrylamide, N-methylolacrylamide, N-methylolmethacrylamide, N-methylolallylcarbamate, and N-methylol lower alkyl ethers or N-methylol lower alkanoic acid esters of N-methylolacrylamide, N-methylolmethacrylamide and N-methylolallylcarbamate. If such an additional ethylenically unsaturated comonomer is used, about 0.5 to 2 wt % is preferred.

A particularly preferred comonomer for increasing the water resistance of the copolymer is one of the alkenoic acids, namely crotonic acid at up to 3 wt %, preferably 0.5 to 1.5 wt %.

Contemplated as the functional, or operative, equivalent of vinyl acetate in the copolymer emulsions, are vinyl esters of $C_1$–$C_{18}$ alkanoic acids, such as vinyl formate, vinyl proprionate, vinyl laurate and the like.

Binder compositions contemplated by this invention contain from 0.5 to 15 wt %, preferably 3 to 10 wt % AGA. AGA and a process for its preparation are known from British Patent No. 1,103,916. AGA can be purchased from Societe Francaise Hoechst (American Hoechst is the distributor in the U.S.).

VAE/AGA emulsion copolymers can be prepared by direct addition of AGA into a monomer solution of vinyl acetate and ethylene or, in the alternative, AGA may be prepared in situ according to the procedures disclosed in U.S. Pat. No. 4,289,676, which is incorporated by reference, herein.

Methods for preparing vinyl acetate/ethylene (VAE) emulsion copolymers are well known in the art and any of the customary procedures, together with the incorporation of an ethylene inlet source, can be used, such as those emulsion polymerization techniques described in chemistry texts such as POLYMER SYNTHESIS, Vol I and II, by Stanley R. Sandler and Wolf Karo, Academic Press, New York and London (1974), and PREPARATIVE METHODS OF POLYMER CHEMISTRY, Second Edition, by Wayne R. Sorenson and Tod W. Campbell, Interscience Publishers (John Wiley & Sons), New York (1968).

In general, suitable VAE emulsion copolymers can be prepared by copolymerization of the monomers in an aqueous medium under pressures generally not exceeding about 100 atm and in the presence of a redox system which is added incrementally, the aqueous system being maintained by a suitable buffering agent at a pH of about 1.5 to 4.5. Preferably, the pH is maintained between 2.25 and 3.0.

The process first involves a homogenization in which the vinyl acetate suspended in water is thoroughly agitated in the presence of ethylene under the working pressure to effect solution of the ethylene in the vinyl acetate while the reaction medium is gradually heated to a polymerization temperature. The homogenization period is followed by a polymerization period during which the redox system is incrementally added.

The crosslinking monomer, AGA, may be added all at once with the vinyl acetate and ethylene or added incrementally over the course of the polymerization reaction, with the latter being preferred. Advantageously a portion of the AGA is added during the beginning of the polymerization reaction, not added at all during the middle period and again added during the last part of the polymerization reaction.

Minor amounts of a polyolefinic comonomer, e.g. 0.01 to 3.0 wt %, preferably 0.05 to 1.5 wt % based upon vinyl acetate, such as triallyl cyanurate, diallyl maleate and the like can be added to increase the molecular weight of the polymer. Sodium vinyl sulfonate can be added to increase mechanical stability of the emulsion and reduce grits.

Various free-radical forming sources such as peroxides can be used in carrying out the polymerization of the monomers. Combination type systems employing both reducing agents and oxidizing agents, i.e. a redox system, are especially preferred. Suitable reducing agents include bisulfites, sulfoxylates, alkali metal bisulfite-ketone adducts, or other compounds having reducing properties such as ascorbic acid, erythorbic acid and other reducing sugars. The oxidizing agents include hydrogen peroxide, organic peroxides such as t-butyl hydroperoxide and the like, and persulfates, such as ammonium or potassium persulfate.

Specific redox systems which can be used include hydrogen peroxide and zinc formaldehyde sulfoxylate; hydrogen peroxide and erythorbic acid, hydrogen peroxide, ammonium persulfate or potassium persulfate with sodium meta-bisulfite, sodium bisulfite, ferrous sulfate, zinc formaldehyde sulfoxylate or sodium formaldehyde sulfoxylate; and t-butyl hydroperoxide with sodium bisulfite-acetone adduct. Other free radical forming systems that are well known in the art can also be used to polymerize the monomers.

Obviously, for a completely formaldehyde-free binder emulsion the redox system must comprise a reducing agent that does not liberate formaldehyde; i.e. ascorbic or erythorbic acid, a bisulfite or especially an alkali metal bisulfite-ketone adduct.

The oxidizing agent is generally employed in an amount of 0.01 to 1 wt %, preferably 0.05 to 0.5 wt % based on the amount of vinyl acetate introduced into the polymerization system. The reducing agent is ordinarily added in the necessary equivalent amount.

Many of the well known emulsifying agents can be used including ionic and nonionic surfactants such as sodium lauryl sulfate, sodium sulfosuccinate esters and amides, sulfonated alkylbenzenes, alkylphenoxypolyethoxy ethanols and other polyoxyethylene condensates.

The useful concentration range of the total amount of emulsifying agents is form less than 0.5 to about 5 wt % based upon the aqueous phase of the emulsion regardless of solids content.

In addition to or in place of the surfactants, protective colloids such as polyvinyl alcohol and celluloses like hydroxyethyl cellulose, methyl cellulose, hydroxypropylmethyl cellulose and the like can be used as emulsifying or stabilizing agents.

The reaction temperature can be controlled by the rate of redox addition and by the rate of heat dissipation via a reaction vessel water jacket. Generally, it is advantageous to maintain a mean temperature of about 50° C. during the polymerization of the monomers and to avoid temperatures much in excess of 80° C. Although temperatures as low as 0° C. can be used, economically the lower temperature limit is about 30° C.

The reaction time will depend upon variables such as temperature, the free radical forming source and the desired extent of polymerization. It is generally desirable to continue with the reaction until less than 0.5% of the vinyl acetate remains unreacted.

At least about 25% of the total amount of vinyl acetate to be polymerized is initially charged into the polymerization vessel and saturated with ethylene with the remainder of the vinyl acetate being added continuously or incrementally during the polymerization. Preferably all the vinyl acetate is charged initially with no additional incremental supply.

When reference is made to incremental addition, whether with respect to vinyl acetate, the redox system employed or any other ingredient, it is understood that intermittent additions is also contemplated. Such intermittent additions are also referred to as "delay" additions.

The quantity of ethylene entering into the copolymer is influenced by the pressure, the agitation and the viscosity of the polymerization medium. Thus, to increase the ethylene content of the copolymer, higher pressure, greater agitation and lower viscosity are employed.

The process for forming the VAE copolymer emulsion generally comprises the preparation of an aqueous solution containing the emulsifying system and, optionally, the buffering system. This aqueous solution and the initial or total charge of the vinyl acetate are added to the polymerization vessel and ethylene pressure is applied to the desired value. The pressurized ethylene source can be shut off from the reactor so that the ethylene pressure decays as it is polymerized or it can be kept open to maintain the ethylene pressure throughout the reaction, i.e. make-up ethylene.

As previously mentioned, the mixture is thoroughly agitated to dissolve ethylene in the vinyl acetate and in the water phase. Conveniently, the charge is brought to polymerization temperature during this agitation period. The polymerization is then initiated by introducing initial amounts of the oxidant, the reductant having been added with the initial charge. After the polymerization has started, the oxidant and reductant are incrementally added as required to continue polymerization. Any other copolymerizable monomer and the remaining amounts of vinyl acetate and/or AGA, if any, may be added as separate delays.

As mentioned, the reaction is generally continued until the residual vinyl acetate drops below about 0.5%. The completed reaction product is then allowed to cool to about room temperature while sealed to the atmosphere.

Zirconium (III) salts of alpha or beta hydroxycarboxylic acids contemplated by this invention which are stable in the AGA-containing binder at room temperature include, by way of example, zirconium ammonium lactate, zirconium ammonium trilactate, zirconium ammonium citrate, zirconium ammonium tartrate and zirconium ammonium glycolate.

Generally, from 0.1 to about 5.0 wt % of a zirconium III organic salt based upon the amount of nonwoven substrate is added to the binder composition. Preferably, from 1.0 to 4.0 wt % of the zirconium III organic salt is added to optimize crosslinking between the zirconium ion and the aminoplast functionality of AGA. However, the amount of zirconium salt added should not exceed that amount capable of reacting to form the crosslinked product because unreacted zirconium salts present within the nonwoven substrate will result in decreased wet tensile strength caused by absorption of water by unreacted zirconium III organic salt.

Typically, the zirconium III salts of alpha or beta hydroxycarboxylic acids contemplated by this invention are stable at low pH (1.5–4.5) in binder compositions with high solids content (30–35 wt % based upon the amount of binder composition) and in the presence of carboxyl and hydroxyl moieties. However, these binder compositions will crosslink when heated to 250°–300° F.

Preferred zirconium III salts of alpha or beta hydroxycarboxylic acids have a stoichiometric ratio of zirconium ions to acid moiety of as least 1.75:1. Zirconium III salts of alpha or beta hydroxycarboxylic acids currently available on the market typically contain less than this desired stoichiometric amount of acid. This is often the case because of reaction parameters and the affinity of zirconium compounds to reaction with themselves. To ensure that a sufficient amount of zirconium III salt is present in the binder composition to effect crosslinking, the stoichiometric ratio should be measured and if the feed is found to be deficient in acid content, an additional amount of alpha or beta hydroxycarboxylic acid must be added into the copolymer composition to raise the stoichiometric ratio of zirconium ion/hydroxycarboxylic acid moiety to at least 1.75:1.

In a preferred embodiment the ratio of zirconium ion/hydroxycarboxylic acid moiety is adjusted ot at least 2:1 but not greater than 3:1 to yield a binder composition which is stable at ambient temperature for approximately 24 hours. This ratio can be increased or decreased depending upon the amount of time desired for storage of the binder composition prior to application onto the nonwoven substrate and curing.

It has been found that the zirconium III salts of alpha or beta hydroxycarboxylic acids can be advantageously formed in situ by adding zirconium ammonium carbonate and an amount in excess of two molar equivalents of the desired alpha or beta hydroxycarboxylic acid into the binder composition. This is particularly advantageous because zirconium ammonium carbonate is relatively inexpensive and is readily available in bulk quantities. Zirconium ammonium carbonate can be purchased from Magnesium Elektron, Inc., Flemington, N.J. Particular alpha or beta hydroxycarboxylic acids which can be reacted in situ with zirconium ammonium carbonate to from the zirconium III salt complexes contemplated by this invention include tartaric acid, lactic acid, citric acid, glycolic acid and ammonium trilactic acid.

It has also been found that zirconium ammonium carbonate cannot be added directly into the AGA-containing copolymer emulsion without also adding the desired alpha or beta hydroxycarboxylic acid because the components will immediately begin to react at room temperature thereby causing the binder to crosslink, increase in viscosity and drop out of solution.

In a preferred embodiment, zirconium ammonium citrate is formed in situ by adding citric acid to zirconium ammonium carbonate. Zirconium ammonium citrate is stable at room temperature in the AGA-containing binder emulsion at pH values of 1.5 to about 4.5. This resulting stability allows for addition of the zirconium III complex prior to effecting curing. The crosslinking can later be initiated by raising the temperature of the zirconium-containing binder to 250° to 300° F. for a sufficient time to effect curing.

Without being held to a particular theory, Applicants believe that the improved properties of the claimed binder compositions are related to the ability of the zirconium (III) organic salts to exploit the carboxylic acid group of the AGA as a crosslinking site in addition to stabilizing the immium intermediate formed during the reaction scheme. The additional crosslinking density generated by these zirconium salts provides nonwoven products demonstrating greater strength and solvent resistance particularly toward mineral spirits and methyl ethyl ketone.

Commonly known catalysts are suitable for practicing this invention. For example, acid catalysts such as mineral acids, e.g. hydrogen chloride, or organic acids, e.g. oxalic acid, or acid salts such as ammonium chloride, are suitably used as known in the art. The amount of catalyst is generally from 0.5 to 2 wt % of the total polymer.

The AGA-containing copolymer emulsions can be used to prepare nonwoven products or fabircs by a variety of methods known in the art which, in general, involve the impregnation of a loosely assembled mass of fibers with the binder emulsion followed by a moderate heating to dry the mass. In the case of the present invention, this moderate heating also serves to cure the binder by forming a crosslinked interpolymer. Following application of the binder composition to the nonwoven substrate, the product is subjected to heat to effect curing.

The starting fiber layer or mass can be formed by any one of the conventional techniques for depositing or arranging fibers in a web or layer. These techniques include carding, garnetting, air-laying, wet laying and the like. Individual webs or thin layers formed by one or more of these techniques can also be laminated to provide a thicker layer for conversion into a fabric. Typically, the fibers extend in a plurality of diverse directions in general alignment with the major plane of the fabirc, overlapping, intersecting and supporting one another to form an open, porous structure.

When reference is made to "cellulose" fibers, those fibers containing predominantly $C_6H_{10}O_5$ groupings are meant. Thus, examples of fibers to be used in the starting layer are natural cellulose fibers such as wood pulp, cotton and hemp and synthetic cellulose fibers such as rayon and regenerated cellulose. Often the fiber starting layer contains at least 50% cellulose fibers, whether natural or synthetic, or a combination thereof. Often the fibers in the starting layer may comprise natural fibers such as wool, jute; artificial fibers such as cellulose acetate; synthetic fibers such as polyamides, nylon, polyesters, acrylics, polyolefins, i.e. polyethylene, polyvinyl chloride, polyurethane, and the like, alone or in combination with one another.

The fibrous starting layer is subjected to at least one of several types of bonding operations to anchor the individual fibers together to form a self-sustaining web. Some of the better known methods of bonding are overall impregnation or printing the web with intermittent or continuous straight or wavy lines for areas of binder extending generally transversely or diagonally across the web and additionally, if desired, along the web.

The amount of binder composition calculated on a dry weight basis to be applied to the fibrous starting web is that amount which is at least sufficient to bind the fibers together to form a self-sustaining web. Suitable amounts range from about 3 to about 50% by weight of the starting web, preferably from about 5 to about 30 wt % of the starting web. Thus the nonwoven products are suitably dried by passing them through an air oven or the like and then through a curing oven. Typical conditions to achieve optimal crosslinking are drying at 150°-200° F. (66°-93° C.) for 4-6 minutes followed by curing at 250°-300° F. for 3-5 minutes or more. However, other time-temperature relationships can be employed as is well known in the art, shorter times and higher temperature or longer times at lower temperature being used.

An emulsion copolymer containing AGA prepared with an alkali metal bisulfite-ketone adduct, sodium meta-bisulfite, ascorbic acid or erythorbic acid as the reducing agent and zirconium III salts of alpha or beta hydroxycarboxylic acids are 100% formaldehyde-free.

Moreover, there are no formaldehyde donors or emitters present in VAE/AGA binder compositions. N-methylolacrylamide, being prepared from acrylamide and formaldehyde in an equilibrating, reversible reaction will always contain some formaldehyde and will continue to generate formaldehyde until all the NMA has either used or lost its formaldehyde. In contrast, AGA is not prepared using formaldehyde, but rather glyoxylic acid, and though its preparation is by a reversible process, this would release glyoxylic acid and not formaldehyde.

High temperature curing at 250°-300° F. utilizes both the aminoplast and carboxylic acid moieties of the AGA to effect crosslinking. In one condensation reaction sequence, the curing temperature causes the amide nitrogen of one AGA molecule to add to the carbon which is alpha to both the amide nitrogen and the carboxylic acid functionality of the AGA moiety resulting in loss of water. A competing reaction involves the binding of the copolymer to the cellulosic substrate thereby further strengthening the resulting network and preventing adhesive binder failure when the nonwoven substrate is subjected to solvents.

The zirconium III salts of organic acids contemplated by this invention utilize the carboxylic acid moiety of AGA, a functional group not previously utilized in curing binders of current technology. Without limiting the scope of the invention, zirconium III organic salts are believed to coordinate with the carboxylic acid functionality of AGA thereby acting as a crosslinker between two polymer chains each containing AGA.

These AGA-containing polymer chains, crosslinked to one another by coordination of their respective carboxylic acid functionalities to zirconium, can already be crosslinked with the substrate thereby providing an even stronger network. As previously stated, the carboxylic acid group of AGA stabilizes the immium intermediate formed during the crosslinking reaction allowing the intermediate to exist long enough to find a nucleophile. Available nucleophiles include another AGA moiety or any other hydrogen source such as a hydroxyl group from another monomer or from the cellulosic substrate.

The greatest advantage in using binder compositions containing AGA is that they do not contain or release formaldehyde during curing. Therefore, the present invention is particularly well suited for use in disposable goods such as diapers and towelling where such goods come in contact with human skin.

Examples 1 through 4 are provided to demonstrate the preparation of various VAE/AGA copolymer emulsions. The copolymer emulsions prepared by these examples were then rected with a zirconium III salt of an organic acid and diluted with deionized water to 9.0% solids. The amount of zirconium III organic salt cited in the following Tables was added to the copolymer emulsions and the pH adjusted with maleic acid to the indicated level. Whatman #4 chromatography paper was saturated with the binder, the samples were dried, heated at 300° F. for five minutes and then subjected to tensile testing. Example 5 demonstrates the preparation of a nonwoven substrate treated with various VAE/AGA emulsions containing zirconium III salts of organic acids.

EXAMPLE 1

This example illustrates the preparation of a VAE/AGA copolymer emulsion. A 1-gallon reactor was charged with 1142.7 g of a 2% aqueous solution of Natrosol 250LR carboxymethylcellulose, 1364.8 g vinyl acetate, 15.2 g Rewopol NOS25, an alkylphenol ethoxylate sulfate sodium salt, 33.9 g Siponate DS-10 sodium dodecyl benzene sulfonate, 27.0 g of a 25% aqueous solution of sodium vinyl sulfonate, 1.6 g triallyl cyanurate, 6.1 g phosphoric acid, 0.05 g ferric ammonium sulfate and 30.4 g of an activator solution (2.0 g sodium meta-bisulfite, 1.2 g acetone and 436.8 g deionized water) and purged for 40 minutes with nitrogen. The kettle was heated to 48° C., agitated at 800 rpm, pressurized with ethylene to 340 lbs. and initiated by adding a 0.3% aqueous solution of t-butylhydroperoxide at 0.2 ml/min.

Upon initiation, the rate was switched to auto and 525 g of an aqueous solution of monomer (55.0 g AGA, 17.5 g acrylamide, 18.0 g inorganic impurities and 512.0 g deionized water) was added at 2.2 ml/min. Ten minutes later the activator solution was added at 0.3 ml/min. and the reaction temperature was maintained at 49° C. At the two hour mark the monomer delay was halted and was restarted at the four hour mark.

When the free monomer reached 10%, the ethylene make-up was turned off, the catalyst was changed to a 1.5% aqueous solution of t-butylhydroperoxide and the activator to a solution of 10.0 g sodium meta-bisulfite and 6.0 g acetone in 424.0 g deionized water. The rate of addition was controlled such that 1.5 ml of activator was added per ml of catalyst and a 2° C. exotherm was maintained. The monomer delay was complete at 6 hours whereupon the free monomer was then 1.5% so the reaction was cooled, degassed and treated with 5 g of a 10% aqueous solution of 5-butylhydroperoxide and 4.6 g of a 50% aqueous solution of Colloid 585 surfactant. Total solids: 42.2%; Viscosity: 100 cps.

EXAMPLE 2

This example is a repeat of Example 1 except the monomer solution contained 55.0 g AGA, 17.5 g acrylamide and 477 g deionized water. Solids: 42.0% Viscosity: 120 cps.

EXAMPLE 3

This example is similar to Example 1 except 493.0 g of monomer solution (55.0 g AGA, 17.5 g acrylamide and 477.5 g deionized water) was added at 2.1 ml/min. and 17.0 g crotonic acid was included in the premix. Solids: 43%; Viscosity: 440 cps.

EXAMPLE 4

This example is similar to Example 1 except 493.0 g of monomer solution (55.0 g AGA, 17.5 g acrylamide and 477.5 g deionized water) was added at 2.1 ml/min. and 24.7 g of a 25% aqueous solution of polyacrylic acid was included in the premix. Solids: 40.0%; Viscosity: 172 cps.

EXAMPLE 5

This example demonstrates the preparation of a binder substrate treated with a VAE/AGA copolymer emulsion containing a zirconium III salt of an organic acid. VAE/AGA emulsions prepared according to Examples 1 through 4 were reacted with a zirconium salt of an organic acid to effect curing of the emulsion. These emulsions were then diluted with deionized water to 9.0% solids. The weight percentage of zirconium III organic salt cited in Table 1 was added and the pH adjusted with maleic acid to the indicated level. For example, to 138.3 g of a VAE/AGA emulsion (43.4% solids) was added 0.6 g Wacker XF-B41-08 polysilane defoamer followed by a solution of 6.0 g Bacote 20 zirconium ammonium carbonate in 44.1 g deionized water to which had been added 1.4 g citric acid. Then 9.0 g of a 2.5% aqueous solution of Natrosol 250ML carboxymethylcellulose was added and the pH adjusted to 2.5 with 0.6 g maleic acid. Whatman #4 chromatography paper was saturated with the binder, the samples were dried, subjected to 300° F. for five minutes and then subjected to tensile testing.

Solids: 32.0%; Viscosity: 200 cps.

TABLE 1

| Run | Zirconium Salt (wt %) | pH | Dry Tensile* | Wet Tensile* | Perc Tensile* | MEK Tensile* |
|---|---|---|---|---|---|---|
| 1 | — | 2.5 | 15.8 | 6.4 | — | 6.2 |

TABLE 1-continued

| Run | Zirconium Salt (wt %) | pH | Dry Tensile* | Wet Tensile* | Perc Tensile* | MEK Tensile* |
|---|---|---|---|---|---|---|
| 2 | ALA (0.1) | 2.5 | 17.3 | 6.1 | 8.7 | 6.5 |
| 3 | ALA (0.25) | 2.5 | 18.3 | 6.7 | 8.8 | 6.4 |
| 4 | ALA (0.5) | 2.5 | 18.1 | 7.8 | 9.5 | 7.3 |
| 5 | ALA (1.0) | 2.5 | 17.9 | 7.9 | 9.0 | 7.3 |
| 6 | ALA (2.0) | 2.5 | 18.9 | 7.8 | 10.8 | 8.4 |
| 7 | AZC (0.5) | 2.5 | 19.1 | 7.2 | 9.0 | 7.4 |
| 8 | AZC (1.0) | 2.5 | 19.4 | 7.2 | 9.7 | 8.1 |
| 9 | AZC (2.0) | 2.5 | 19.8 | 7.3 | 10.3 | 8.8 |
| 10 | AZC (4.0) | 2.5 | 18.5 | 5.7 | 10.2 | 8.2 |

*Lbs. per linear square inch

Table 1 presents a ladder study of VAE/AGA emulsion copolymers prepared according to Example 1 wherein the runs contain from 0–2.0 wt % of the enumerated zirconium III salts of alpha or beta hydroxycarboxylic acids. The pH of each run was adjusted to 2.5. Abbreviations for the various zirconium salts used in this Table and subsequent Tables are defined in Table 6. With the exception of runs 1 and 10, the addition of as low as 0.1 wt % zirconium III salt of an organic acid resulted in a substantial improvement in both wet and dry tensile strength. Run 6 demonstrates that addition of 2.0 wt % zirconium ammonium lactate to the copolymer emulsion prepared by Example 1 improved dry tensile strength from 15.8 to 18.9 pounds per linear square inch. Significant improvement in wet tensile strength, particularly with regard to resistance to solvent attack by perchloroethylene and methyl ethyl ketone, is afforded by the post crosslinking between the AGA and zirconium III salt complex. The low wet tensile strength of Run 10 (5.7 lsi) is attributed to water absorption by unreacted zirconium III organic salt which increases the total amount of water absorbed by the substrate resulting in decreased tensile strength.

TABLE 2

| Run | Emulsion Example | Zirconium Salt (wt %) | Dry Tensile* | Wet Tensile* | Perc Tensile* | MEK Tensile* |
|---|---|---|---|---|---|---|
| 11 | 1 | — (0) | 15.8 | 6.4 | — | 6.2 |
| 12 | 1 | ALA (0.5) | 18.1 | 7.8 | 9.5 | 7.3 |
| 13 | | LA (0.5) | 16.8 | 6.1 | 8.0 | 6.4 |
| 14 | 1 | SC (0.5) | 16.4 | 6.0 | 8.2 | 6.4 |
| 15 | 1 | ST (0.5) | 16.1 | 5.5 | 7.9 | 6.2 |
| 16 | 2 | AZC (0.5) | 17.8 | 6.8 | 8.2 | 6.6 |
| 17 | 2 | — (0) | 16.0 | 6.7 | — | 5.9 |
| 18 | 2 | ALA (1.0) | 18.4 | 7.6 | 9.6 | 7.2 |

*Lbs per linear square inch.

Table 2 discloses wet and dry tensile strengths for copolymer emulsions prepared according to Examples 1 and 2. The pH of each emulsion was adjusted to 2.5 and then treated with the designated amount and type of zirconium III organic salt. According to the test results, crosslinking afforded by zirconium ammonium lactate provided the greatest increase in both wet and dry tensile strength. Runs 12 prepared according to Example 1 demonstrates that addition of 0.5 wt % of zirconium ammonium lactate to the copolymer emulsion increased wet and dry tensile strengths by 21.9% and 14.5%, respectively. Similar increases in tensile strength were afforded by addition of zirconium III adducts to runs 16 through 18 prepared according to Example 2.

TABLE 3

| Run | Emulsion Example | % ALA | pH | Dry Tensile* | Wet Tensile* | Perc Tensile* | MEK Tensile* |
|---|---|---|---|---|---|---|---|
| 19 | 1 | 0 | 2.5 | 15.8 | 6.4 | — | 6.2 |
| 20 | 1 | 0.5 | 1.75 | 14.8 | 6.1 | 7.1 | 5.8 |
| 21 | 1 | 0.5 | 2.5 | 18.1 | 7.8 | 9.5 | 7.3 |
| 22 | 1 | 0.5 | 3.25 | 18.5 | 6.2 | 8.8 | 6.7 |
| 23 | 1 | 0.5 | 4.0 | 17.9 | 5.4 | 8.3 | 6.3 |
| 24 | 4 | 0 | 2.5 | 16.5 | 6.4 | — | 6.4 |
| 25 | 4 | 0.5 | 1.75 | 15.9 | 6.7 | 8.2 | 6.5 |
| 26 | 4 | 0.5 | 2.5 | 19.6 | 6.5 | 8.9 | 6.9 |
| 27 | 4 | 0.5 | 3.25 | 18.8 | 6.3 | 9.6 | 6.7 |
| 28 | 4 | 0.5 | 4.0 | 19.7 | 5.7 | 9.4 | 6.8 |

*Lbs per linear square inch.

Table 3 demonstrates the effect of pH on zirconium ammonium lactate post-curing of binders prepared according to Examples 1 and 4. The results for runs prepared according to Example 1 demonstrate that optimum tensile strengths were obtained when the pH ranged from about 2.5 to 3.25. Comparison of tensile strengths for runs prepared by Example 1 versus Example 4 demonstrate that incremental addition of AGA monomer solution into the VAE copolymer substantially increased wet tensile strength. Run 26 prepared according to Example 4 further containing 0.5% zirconium ammonium lactate exhibited a 9.5% increase in dry tensile strength compared to Run 19 which did not contain any zirconium III organic salt.

TABLE 4

| Run | Emulsion Example | % ALA | pH | Dry Tensile* | Wet Tensile* | Perc Tensile* | MEK Tensile* |
|---|---|---|---|---|---|---|---|
| 29 | 3 | 0 | 2.5 | 16.4 | 6.1 | 8.0 | 5.4 |
| 30 | 3 | 0.25 | 2.5 | 17.1 | 6.6 | 8.2 | 6.4 |
| 31 | 3 | 0.50 | 2.5 | 17.8 | 6.7 | 8.3 | 6.6 |
| 32 | 3 | 1.0 | 2.5 | 18.5 | 6.5 | 9.1 | 6.7 |
| 33 | 3 | 2.0 | 2.5 | 19.0 | 6.4 | 9.6 | 7.3 |
| 34 | 4 | 0 | 2.5 | 14.0 | 5.4 | — | 5.6 |
| 35 | 4 | 0.25 | 2.5 | 16.6 | 5.9 | 7.9 | 5.9 |
| 36 | 4 | 0.50 | 2.5 | 16.8 | 5.9 | 8.6 | 6.4 |
| 37 | 4 | 1.0 | 2.5 | 17.0 | 6.1 | 8.7 | 6.8 |
| 38 | 4 | 2.0 | 2.5 | 18.0 | 6.5 | 9.3 | 7.6 |

*Lbs per linear square inch.

Table 4 illustrates the effect of adding zirconium ammonium lactate to emulsion copolymers prepared according to Examples 3 and 4. The emulsion copolymers of Examples 3 and 4 included the additional components of crotonic acid and polyacrylic acid, respectively. Run 33 demonstrates that addition of 2.0 wt % zirconium ammonium lactate to a copolymer emulsion prepared according to Example 3 containing crotonic acid resulted in a 15.8% improvement in dry tensile strength compared to the same run without the zirconium III organic salt. For example, run 33, prepared according to Example 3 and further containing 2.0% zirconium ammonium lactate, which was wetted with perchloroethylene and methyl ethyl ketone, exhibited a 20% and 30% increase in wet tensile strength, respectively, compared to the same run without addition of the zirconium III organic salt. It was noted that copolymers containing crotonic acid exhibited superior tensile strength and resistance to water and perchloroethylene while addition of polyacrylic acid enhanced tensile strength and solvent resistance to methyl ethyl ketone.

TABLE 5

| Run | Zr Source | Molar Equiv. (Organic acid) | pH | Viscosity (cps) Initial | 4 hrs. | 24 hrs. |
|---|---|---|---|---|---|---|
| 39 | Bacote 20 | | 3.0 | 640 | 1580 | 3800 |
| 40 | Zirtech ALA | | 3.0 | 1780 | 2310 | 2750 |
| 41 | Bacote 20 | 0.6 ($CaCO_3$) | 3.0 | Incompatible | | |
| 42 | Bacote 20 | 0.3 (Citric Acid) | 3.0 | 5680 | Paste | |
| 43 | Bacote 20 | 2.0 (Citric Acid) | 3.0 | 220 | 230 | 260 |
| 44 | $ZrOCl_2$ | 3.5 (Citric Acid) | 2.0 | 934 | — | 1234 |
| 45 | $ZrOCl_2$ | 0.9 (Tartaric Acid) | 3.0 | Incompatible | | |
| 46 | $Zr(OAc)_2$ | 1.1 (Tartaric Acid) | 3.0 | Incompatible | | |
| 47 | Bacote 20 | 1.8 (DAP) | 3.0 | 1270 | — | 1000 |
| 48 | Bacote 20 | 2.0 (Tartaric Acid) | 3.0 | 172 | 160 | 144 |

Table 5 demonstrates the stabilizing effect that various organic acids, particularly citric acid, exert on zirconium III complexes in solution with AGA-containing binder compositions prepared according to Example 1. According to run 39, addition of Bacote 20 zirconium ammonium carbonate into the VAE/AGA emulsion copolymer resultd in a viscosity increase of from 640 to 3800 cps over a 24-hour period. In contrast, run 40 demonstrates that direct addition of zirconium ammonium lactate into the binder emulsion resulted in only a small viscosity increase of from 1780 to 2750 cps. over a 24-hour period. The initial viscosity for run 42 (5680 cps) is attributed to a pH associated crosslinking of AGA. Runs 43 and 48 demonstrate that in situ formation of zirconium ammonium citrate and zirconium ammonium tartrate by reaction of zirconium ammonium carbonate with 2.0 molar equivalents of citric acid and tartaric acid, respectively, resulted in binder compositions which did not show any viscosity increase over a 24-hour period.

TABLE 6

Bacote 20=Zirconium Ammonium Carbonate
Zirtech ALA=Zirconium Ammonium Lactate
ALA=Zirconium Ammonium Lactate
LA=Zirconium Sodium Trilactate
SC=Zirconium Ammonium Citrate
ST=Zirconium Sodium Tartrate
AZC=Zirconium Ammonium Carbonate
Perc=Perchloroethylene
MEK=Methyl ethyl ketone
DAP=Diammonium phosphate

STATEMENT OF INDUSTRIAL APPLICATION

The invention provides binder compositions containing acrylamidoglycolic acid and a zirconium III salt of an organic acid as a curing agent which are useful in the preparation of nonwoen products. The binder compositions containing zirconium III salts are stable at room temperature and can be stored until it is desired to induce the crosslinking mechanism by application of heat.

We claim:

1. A nonwoven product comprising a nonwoven web of fibers bonded together with an amount of a binder composition sufficient to bind said fibers together to form a self-sustaining web wherein said binder composition comprises:

(a) an aqueous medium having colloidally dispersed therein a vinyl acetate/ethylene copolymer comprising from 0.5 to 15% by weight of recurring units of formula I where R is H and $CH_3$;

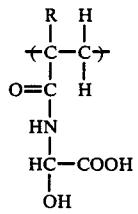

Formula I (b) 0.1 to 5.0 wt % of a zirconium III salt of an alpha or beta hydroxycarboxylic acid based upon the nonwoven substrate wherein the molar ratio of zirconium ion to acid is at least 1.75:1; and (c) the pH of said binder composition is about 1.5 to about 4.5.

2. A nonwoven product according to claim 1 wherein the zirconium III salt of an alpha or beta hydroxycarboxylic acid is selected from the group consisting of zirconium ammonium citrate, zirconium ammonium tartrate, zirconium ammonium lactate, zirconium ammonium glycolate and zirconium ammonium trilactate.

3. A nonwoven product according to claim 1 wherein the copolymer of said binder composition contains 1 to 30% ethylene.

4. A nonwoven product according to claim 1 wherein the copolymer of said binder composition contains 60 to 95wt % vinyl acetate.

5. A nonwoven product comprising a nonwoven web of fibers bonded together with the binder composition of claim 1 wherein the amount of said binder composition is about 3% to 50% by weight of the starting web.

6. A nonwoven product comprising a nonwoven web of fibers bonded together with the binder composition of claim 1 wherein the amount of said binder composition is about 5% to 30% by weight of the starting web.

7. In a binder composition for nonwoven fabrics comprising a copolymer containing acrylamidoglycolic acid and a curing agent, the improvement comprising 0.1 to 5.0 wt % of a zirconium III salt of an alpha or beta hydroxycarboxylic acid based upon the nonwoven substrate wherein the molar ratio of zirconium ion to acid is at least 1.75:1 and the pH of said binder composition is about 1.5 to about 4.5.

8. The binder composition for nonwoven fabrics according to claim 7 wherein the zirconium III salt of an alpha or beta hydroxycarboxylic acid is selected from the group consisting of zirconium ammonium citrate, zirconium ammonium tartrate, zirconium ammonium lactate, zirconium ammonium glycolate and zirconium ammonium trilactate.

9. A binder composition for nonwoven fabrics comprising:

(a) an aqueous medium having colloidally dispersed therein a vinyl acetate/ethylene copolymer further comprising from 0.5 to 15% by weight of recurring units of formula I where R is H and $CH_3$;

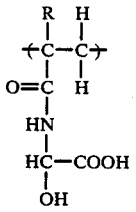

Formula I (b) 0.1 to 5.0 wt % of a zirconium III salt of an alpha or beta hydroxycarboxylic acid based upon the nonwoven substrate wherein the molar ratio of zirconium ion to acid is at least 1.75:1; and (c) the pH of said binder composition is about 1.5 to 4.5.

10. A binder composition for nonwoven fabrics according to claim 9 wherein the zirconium III salt of an alpha or beta hydroxycarboxylic acid is selected from the group consisting of zirconium ammonium citrate, zirconium ammonium tartrate, zirconium ammonium lactate, zirconium ammonium glycolate and zirconium ammonium trilactate.

11. A binder composition for nonwoven fabrics according to claim 9 wherein the alpha or beta hydroxycarboxylic acid is selected from the group consisting of citric acid, tartaric acid, lactic acid, glycolic acid and ammonium trilactic acid.

12. The binder composition of claim 9 in which the copolymer contains from 1 to about 30 wt % ethylene, based on vinyl acetate.

13. The binder composition of claim 9 in which the copolymer also contains 0.1 to about 30 wt % of a $C_3$–$C_{10}$ alkenoic acid comonomer based upon the amount of vinyl acetate.

14. The binder composition of claim 13 in which the alkenoic acid is crotonic acid.

15. The binder composition of claim 9 in which the copolymer contains from 55 to about 95 wt % vinyl acetate.

16. A binder composition for nonwoven fabrics comprising:

(a) an aqueous medium having colloidally dispersed therein a vinyl acetate/ethylene copolymer further comprising from 3.0 to 10% by weight of recurring units of formula I where R is H and $CH_3$;

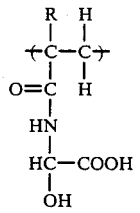

Formula I (b) 1.1 to 4.0 wt % of a zirconium III salt of an alpha or beta hydroxycarboxylic acid based upon the nonwoven substrate wherein the molar ratio of zirconium ion to acid is at least 1.75:1; and (c) the pH of said binder composition is about 2.25 to about 3.0.

17. The binder composition of claim 11 wherein the zirconium III salt of an alpha or beta hydroxycarboxylic acid is selected from the group consisting of zirconium ammonium citrate, zirconium ammonium tartrate, zirconium ammonium lactate, zirconium ammonium glycolate and zirconium ammonium trilactate.

18. The binder composition of claim 16 in which the copolymer contains 7 to 20 wt % ethylene based upon the amount of vinyl acetate.

19. The binder composition of claim 16 in which the copolymer also contains 0.5 to 3 wt % of a $C_3$–$C_{10}$ alkenoic acid comonomer based upon the amount of vinyl acetate.

20. The binder composition of claim 16 in which the copolymer also contains 0.5 to 1.5 wt % crotonic acid based upon the amount of vinyl acetate.

* * * * *